United States Patent [19]

Daime et al.

[11] Patent Number: 4,489,579

[45] Date of Patent: Dec. 25, 1984

[54] MONITORING DEVICE AND PROCESS OF A METALLIC PART SUPERPLASTIC FORMING

[75] Inventors: Jean P. Daime, Boissy St. Leger; Martial H. Lecler, Darvault, both of France

[73] Assignee: S.N.E.C.M.A., Paris, France

[21] Appl. No.: 475,694

[22] Filed: Mar. 15, 1983

[30] Foreign Application Priority Data

Mar. 17, 1982 [FR] France ..... 82 04862

[51] Int. Cl.[3] ..... B21B 9/00

[52] U.S. Cl. ..... 72/38; 72/60; 72/342; 72/364

[58] Field of Search ..... 72/38, 60, 342, 364, 72/20

[56] References Cited

U.S. PATENT DOCUMENTS

| | | | |
|---|---|---|---|
| 3,934,440 | 1/1976 | Berg . | |
| 3,934,441 | 1/1976 | Hamilton | 72/60 |
| 3,974,673 | 8/1976 | Fosnes | 72/56 |
| 4,011,744 | 3/1977 | Ershov . | |
| 4,087,037 | 5/1978 | Schier | 228/106 |
| 4,181,000 | 1/1980 | Hamilton . | |
| 4,233,829 | 11/1980 | Hamilton . | |
| 4,266,416 | 5/1981 | Festag | 72/60 |

FOREIGN PATENT DOCUMENTS

| | | |
|---|---|---|
| 115957 | 11/1941 | Australia . |
| 127420 | 10/1900 | Fed. Rep. of Germany . |
| 1485606 | 3/1966 | France . |
| 1557815 | 12/1967 | France . |
| 2076722 | 5/1981 | United Kingdom . |

*Primary Examiner*—Leon Gilden

*Attorney, Agent, or Firm*—Oblon, Fisher, Spivak, McClelland & Maier

[57] ABSTRACT

In a mold for the superplastic forming of a piece from a blank, the distortion of the blank is measured by a hollow tube located within the mold and having one end positioned in contact with the blank. The hollow tube extends through a sleeve fixed to the mold and includes an axial array of holes. A bore in the sleeve is connected to a source of low pressure gas via a delivery tube so that the low pressure gas can selectively communicate with the interior of the hollow tube as the movement of the tube causes the selective registry of the holes therein with the delivery tube. Such selective registry causes a pressure drop in the delivery tube which is measured by a pressure drop detector and accompanying recorder. Electrical leads are provided on the inner surface of the mold for evaluating when the distortion of the blank causes the face of the blank to reach selected portions of the mold inner surface.

10 Claims, 1 Drawing Figure

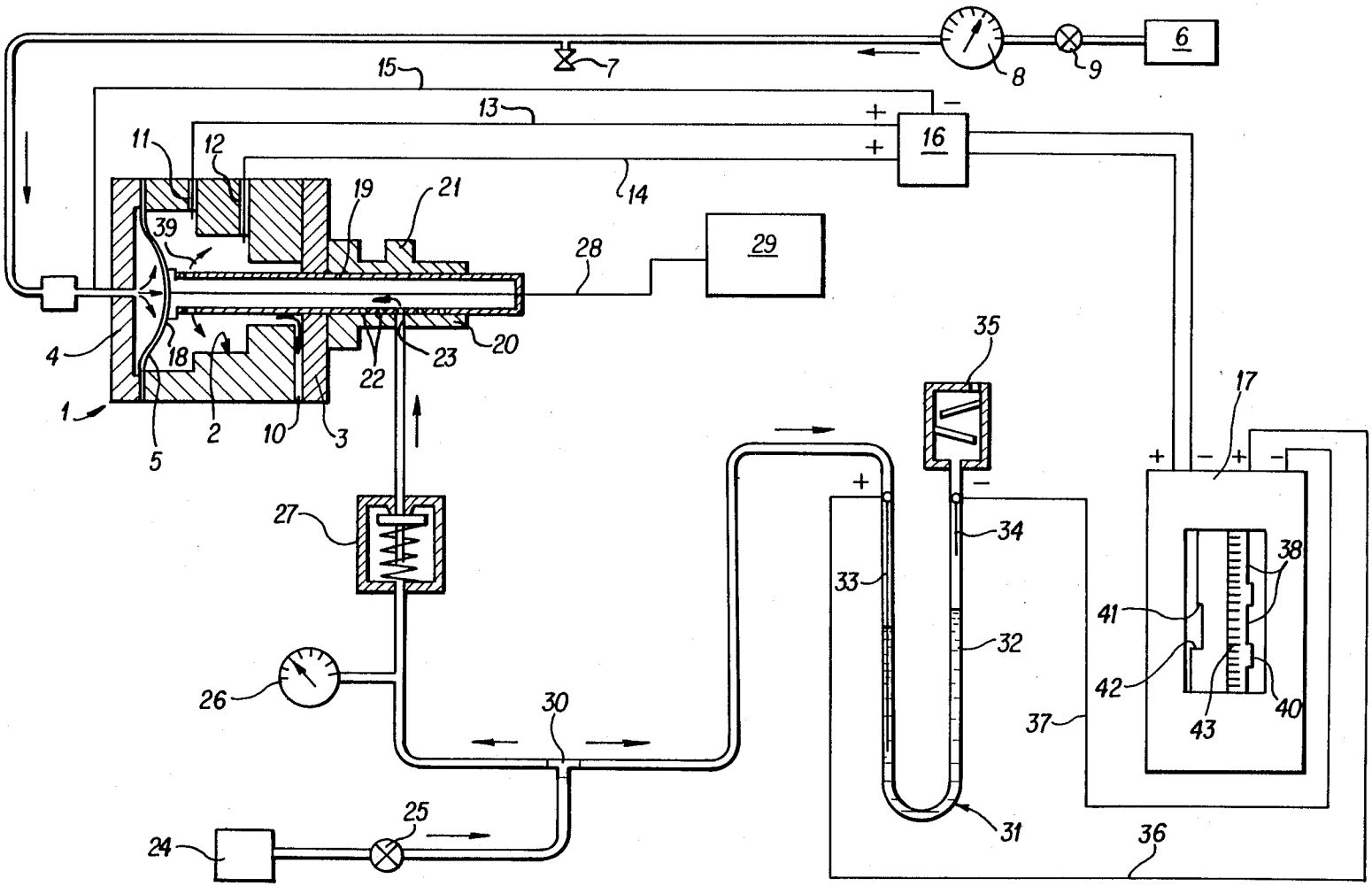
6
9
8
7
16
17
38
40
43
41
42
36
37
35
34
32
31
33
29
14
28
13
15
21
19
20
23
22
3
10
12
2
11
39
18
5
4
1
27
30
26
25
24

MONITORING DEVICE AND PROCESS OF A METALLIC PART SUPERPLASTIC FORMING

BACKGROUND OF THE INVENTION

1. Field of the Invention

The present invention relates to a device for monitoring the superplastic forming of a metallic piece from a blank positioned at the entrance of a mold charged by compressed gas.

2. Description of the Prior Art

The superplastic forming of metals has been known for several years (see, for example, French Pat. No. 1,495,606). It allows deep shapes to be formed which could not be made in any other way without damaging the metal. It is thus possible to make rough models with a minimum mass, which considerably reduces the machining time necessary to manufacture the finished piece.

Nevertheless, in this forming process, as the metal is being stretched, the thickness of the blank decreases, the deformation rate tends to increase to the extent that critical values are reached which could be detrimental to the quality of the part.

U.S. Pat. Nos. 3,934,440 and 4,011,744, as well as Australian Pat. No. 115,957, teach that these disadvantages can be eliminated by using a device for monitoring the forming step, the device being of the type which has a rigid sliding element for measuring the movement of the central part of the blank. One end of the sliding element rests on the central part of the blank and can slide when the central part of the blank moves. Associated with the sliding element is a system for measuring the movement of the element. The term "central part of the blank" designates the part which deforms the most rapidly, because it is the furthest-removed from the walls of the molds. Although generally located at the center of the blank, this part can nevertheless be positioned away from the center, depending on the exact shape of the mold.

SUMMARY OF THE INVENTION

The present invention has as its object a device for monitoring the forming step which allows the operator to evaluate the development process of the part and to act on the gas pressure in order to modulate the force exerted on the blank as a function of the development of the dimensional parameters of the part being formed.

The invention achieves this object by use of an element in the form of a hollow cylindrical tube which is closed at its end opposite the blank. Its other end rests on the blank and slides in a tight fashion in a cylindrical sleeve. This tube has a series of holes which can pass before a delivery tube opening in the sleeve and which are connected to both a low-pressure gas source and a pressure drop detector. The tube has at least one gas escape orifice and the mold is provided with at least one pierced hole which communicates with the atmosphere. The pressure drop detector is connected to a recording device which emits a signal corresponding to pressure drops detected during the passage of a tube hole before the sleeve delivery tube.

The cylindrical sleeve is advantageously located in the end of the mold opposite the blank and the gas escape orifice is located near the tube end resting on the blank.

The recording device is advantageously a recorder with a chart which runs at a known speed in such a manner that the detection of pressure drops allows the speed of the movement of the measuring element, and so of the central part of the blank, to be known.

In order to have a better understanding of the deformations of the blank, it is advantageous if the monitoring devices also have means for evaluating the progression of the front face of the blank inside the mold. These means are advantageously formed by electrical contacts which touch the inner wall of the mold and are connected to a recorder which can be the chart recorder already used to measure the advance of the central part of the blank.

The electrical contacts are advantageously located at each recess angle of the mold, which allows the arrival of the blank at changes of section of the mold to be evaluated and the gas pressure to be varied as a consequence.

It is advantageous if the device of the invention also has a temperature guage, which informs the operator of the temperature range governing the superplastic forming process.

The invention also has as an object a method of monitoring superplastic forming, in which the movement of an element to be shaped is measured by the tube whose one end rests on the central part of a blank, including step of detecting the pressure drops of a gas in a low-pressure gas circuit, one opening of which can be covered and uncovered by the passage of a movable obturator with a series of holes and connected kinematically to the element.

BRIEF DESCRIPTION OF THE DRAWINGS

Other characteristics and advantages of the invention will be explained in more detail in the following description of a preferred embodiment of the device of the invention with reference made to the sole FIGURE, which schematically shows the forming apparatus and the associated monitoring device.

DETAILED DESCRIPTION OF THE PREFERRED EMBODIMENTS

The sole FIGURE shows the mold or matrix 1, formed with an inside wall 2 which can be stepped according to the geometry of the piece to be formed, and further formed with a bottom 3 and a cover 4.

The roughcast of the piece to be formed constitutes a flat circular blank 5, placed in a tight manner at the opening of mold 1. The enclosed area defined by the concave side of the blank communicates through the cover 4 with a source 6 of argon gas under high pressure past discharge valve 7, high-pressure manometer 8 and stop-valve 9.

Bore 10 establishes communication between the back enclosed area of the mold 1 and the atmosphere.

Each recess angle of mold 1 has one of the bores 11 or 12 positioned thereat. Each of the bores 11 and 12 is filled with electrical insulation traversed by electrical leads 13 and 14, having the same polarity. The end of each of the leads contacts the inner wall 2 of the mold. Lead 15 of an opposite polarity to that of 13 and 14 is connected to the mold entrance. Leads 13, 14 and 15 are connected, via switch 16, to chart recorder 17.

The convex face of blank 5 rests on end 18 of hollow cylindrical tube 19, whose other end 20 is closed. Tube 19 slides essentially without friction and in a tight fashion in the bore of a sleeve 21 fixed to bottom 3 of mold 1.

Tube 19 has a series of regularly axially spaced holes 20 aligned along a portion of its cylindrical surface which can pass before delivery tube 23 provided in sleeve 21. The delivery tube in supplied with low-pressure argon gas from source 24 via pressure-reducing valve 25, manometer 26 and one way valve 27 adjusted to permit return only at high pressure in tube 19.

Thermocouple 28 traverses tube 19, picks up the temperature of blank 5 and transmits it to indicator 29.

Low-pressure argon gas source 24 is also connected, via T-connection 30, to U-shaped glass tube 31, which contains a conductive liquid 32. One end of the tube 31 has expansion chamber 35 mounted thereon. This expansion chamber 35 constitutes a safety device in case a rupture of the piece being formed should suddenly put the high-pressure argon and tube 31 in communication.

The left branch of tube 31 has an electric lead 33 which extends within the tube such that it is in permanent contact with conductive liquid 32, whatever the height of the liquid. The right branch has a shorter electric lead 34 which is only in contact with conductive liquid 32 when the level of the liquid rises in this branch. Contacts 33 and 34 are connected to the positive and negative terminals of recorder 17 by leads 36 and 37.

The structure described above operates as follows. The blank is heated by known means (not shown), such as heater elements, to a temperature which imparts to it characteristics of superplasticity, and is clamped to the opening of mold 1.

The cover 4 is placed on the blank so that the concave side of the blank is put in communication with the source 6 of high-pressure argon gas, thus initiating the molding of the blank by the gas pressure.

At the same time, the supply 24 of low-pressure argon gas is opened. The pressure causes the conductive liquid to rise in the right branch of tube 31 and contact with lead 34 is established, which is indicated by a straight line 38 on the graduation of recorder 17.

Part 5 starts to distort and pushes tube 19 out of the mold.

As soon as the first hole of the series of holes 22 of tube 19 passes before delivery tube 23, the low-pressure argon gas passes into this tube 19, exits through holes 39 provided near its end 18, and then through pierced hole 10 of the mold to the atmosphere.

The pressure of the argon then drops suddenly in the left branch of the U-shaped tube and the contact with lead 34 is terminated in the right branch. This is indicated by a spike 40 in the recording, and so forth.

At the same time, recorder 17 shows at 41 and 42 by means of contacts 11 and 12 the exact moment at which the metal reaches the first, then the second stage of mold 1.

The recording paper moves at a known constant speed. It has a scale 43 which allows the distortion speed of the material to be determined by a simple reading. Thus, the operator can act on the argon gas pressure 6 in order to adapt it to the geometric characteristics of the piece.

This modulation of the forming pressure can be automated and programmed as a function of the signals received by the recorder (and as a function of the characteristics of the part and of the material).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a mold for the superplastic forming of a part from a blank, said mold including an inner surface having at least one recess angle and an opening for said blank, a device for monitoring said forming, said device comprising:

a sleeve fixed to said mold;

a hollow cylindrical tube slidable in said sleeve, one end of said hollow tube being positionable in contact with a central part of one side of said blank when said blank is in said mold;

means for providing high pressure fluid to the other side of said blank for forming said part;

an axial array of at least two holes extending through a peripheral cylindrical wall of said hollow tube;

a delivery tube having one end extending through said sleeve for selective communication with said holes of said hollow tube when one of said holes registers with said delivery tube;

a low pressure gas source communicating with a second end of said delivery tube;

at least one first gas escape orifice in said hollow tube;

at least one second gas escape orifice in said mold;

a pressure drop detector in fluid communication with said delivery tube; and a pressure recorder operatively connected to said pressure drop detector, whereby the registry of one of said holes in said hollow tube with said delivery tube, due to distortion of said blank, causes a pressure drop in said delivery tube, said pressure drop being detected by said pressure drop detector and recorded by said pressure recorder.

2. The device of claim 1 wherein said sleeve is fixed to said mold at a position opposite said opening.

3. The device of claim 1 wherein said first gas escape orifice is positioned adjacent said one end of said hollow tube.

4. The device of claim 1 wherein said recorder is a chart recorder.

5. The device of claim 1 wherein said pressure drop detector comprises:

a U-shaped tube having one end in fluid communication with said delivery tube;

an electrically conductive liquid in said U-shaped tube; and electrical contact means for detecting the liquid level in the legs of said tube, said electrical contact means being operatively connected to said pressure recorder.

6. The device of claim 1 including means for evaluating the movement of the face of said blank along said inner surface of said mold as said blank distorts.

7. The device of claim 6 wherein said means for evaluating comprise electrical leads in said inner surface of said mold and operatively connected to said recorder.

8. The device of claim 1 including means for determining the temperature of said blank.

9. The device of claim 8 wherein said means for determining the temperature of said blank comprise a thermocouple in said one end of said hollow tube.

10. A method of monitoring the superplastic forming of a piece from a blank in a compressed gas charged mold including a movable hollow element having one end contacting said blank and having a plurality of holes, said method comprising the steps of:

selectively communicating one of said holes with a low pressure circuit as said hollow element is moved by the distortion of said blank; and measuring pressure drops in said low pressure circuit due to said selective communication.

* * * * *